United States Patent [19]

Lehmann et al.

[11] 4,226,045

[45] Oct. 7, 1980

[54] STACKABLE TOY

[75] Inventors: Roger W. Lehmann, Belle Mead; Vincent F. Siravo, New Monmouth, both of N.J.

[73] Assignee: Knickerbocker Toy Co., Inc., Middlesex, N.J.

[21] Appl. No.: 23,020

[22] Filed: Mar. 22, 1979

[51] Int. Cl.[3] ..... A63H 33/08

[52] U.S. Cl. ..... 46/25; 46/153

[58] Field of Search ..... 46/25, 26, 29, 31, 151, 46/153; 40/605, 607; 220/23.4; 206/504; 215/10; 108/53.1

[56] References Cited

U.S. PATENT DOCUMENTS

| | | | |
|---|---|---|---|
| 176,144 | 4/1876 | McDougall | 46/25 |
| 582,625 | 5/1897 | Emery | 46/153 |
| 3,159,403 | 12/1964 | Glass et al. | 46/25 |
| 3,521,764 | 7/1970 | Loomis | 108/53.1 |
| 3,529,741 | 9/1970 | Walker et al. | 220/7 |
| 3,664,273 | 5/1972 | Howe | 108/53.1 |

*Primary Examiner*—Robert A. Hafer

*Attorney, Agent, or Firm*—Stoll and Stoll

[57] ABSTRACT

A stackable toy comprising a doll having a centrally disposed, vertically movable pin, said pin being recessed within the doll when in retracted position and extending upwardly from the doll when in projected position, a socket being formed within the doll below the pin. The projected pin of one such doll is adapted to engage the socket of a second such doll to assemble the two dolls in stacked positions. Each doll is also provided with angularly disposed pin-shaped limbs, e.g. arms, and these limbs are equally engageable with a doll socket. A plurality of dolls made in accordance with this invention may be stacked by means of their respective centrally disposed pins as well as by means of their respective pin-shaped limbs. Various alternative means are provided for extending and retracting the centrally disposed pin. In its simplest form the pin is manually movable into either projected or retracted position. Other alternatives involve the use of helical cams or guide formations on the pin or in the body of the toy or both.

7 Claims, 12 Drawing Figures

Fig. 1.
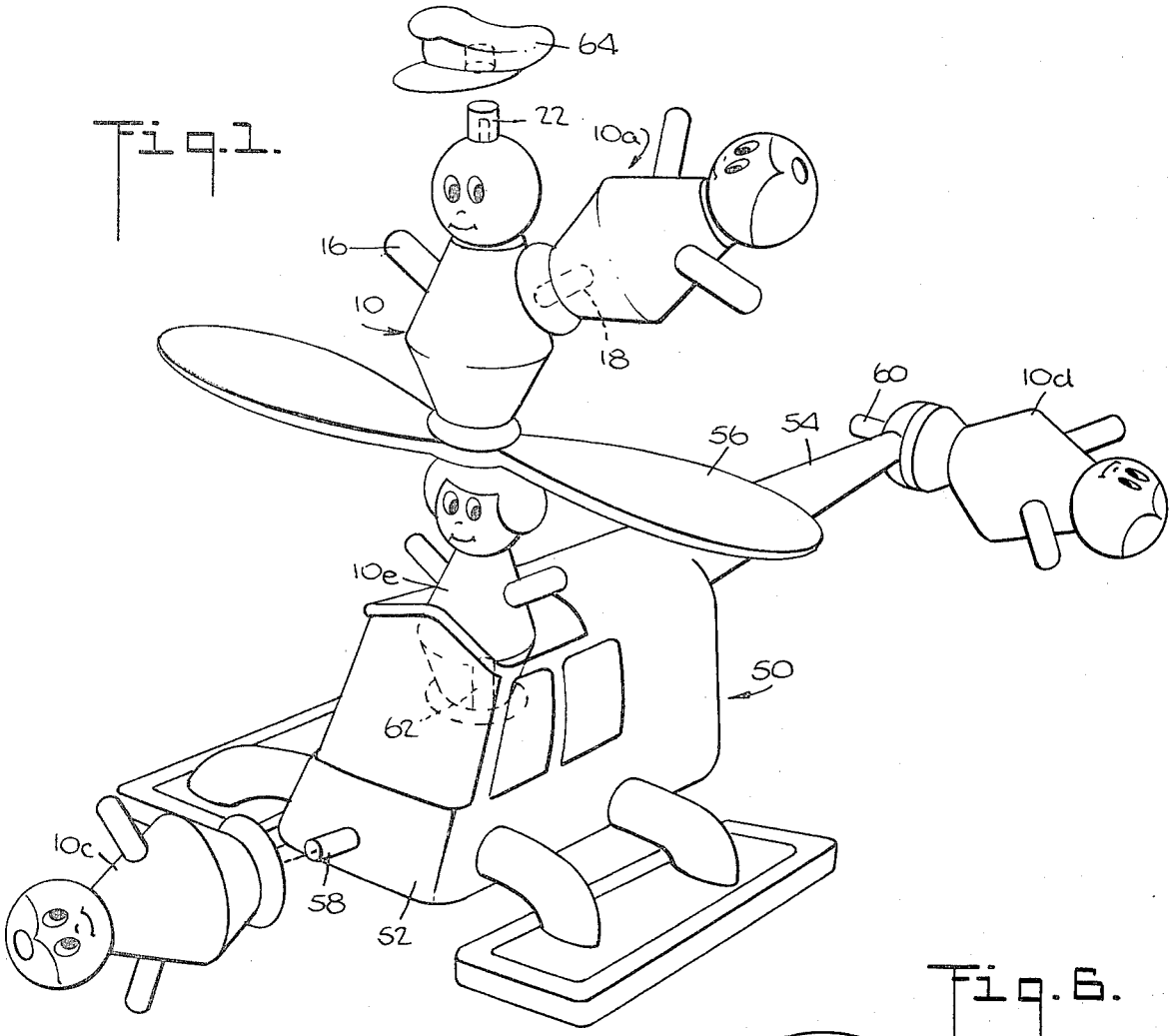
Fig. 6.
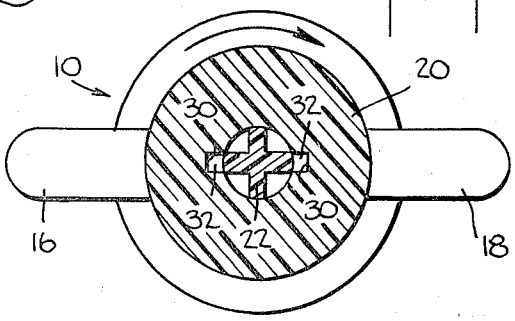
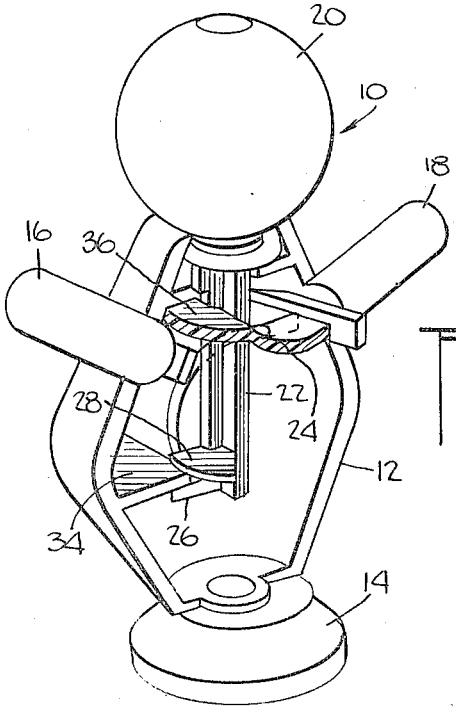
Fig. 2.
Fig. 7.
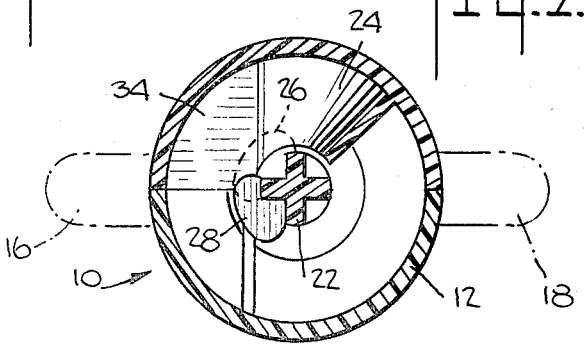

STACKABLE TOY

FIELD OF THE INVENTION

This invention relates to stackable toys for young children.

PRIOR ART

The closest prior art known to applicant consists of the following United States Patents:

| | |
|---|---|
| 268,020 | Howard |
| 440,986 | Alderson |
| 1,407,451 | Vaughan |
| 1,683,561 | Letson |
| 1,918,122 | Naue |
| 3,377,740 | Bonanno et al |
| 3,758,982 | Lemelson et al |
| 4,052,813 | Crain et al |

The closest of these is believed to be Letson, U.S. Pat. No. 1,685,561 which shows a doll having a projecting pin supporting the doll's head. The pin is rotatable to turn the head and it also provides the means for raising and lowering the head. This patent does not however show a doll having a vertically movable pin which is adapted to project at its upward end and having a socket at its lower end, said upwardly projecting end and said socket being adapted to engage two additional dolls of like construction, the pin engaging the socket of one such doll, the socket engaging the pin of the second doll.

SUMMARY OF THE INVENTION

This invention comprises a stackable toy in the form of a doll having the configuration of a selected figure or character. The doll is provided with a longitudinally extensible pin which is upwardly movable to projected position and downwardly movable to retracted position. A Socket is provided in the base of the doll, said socket being adapted to receive the projected pin of a second doll. The upwardly projecting end of the pin is adapted to engage the socket of a third doll. Additionally, each such doll is provided with pin-shaped limbs, for example, arms, which are also engageable with the sockets of additional dolls of like construction. In the preferred form of this invention pin-shaped arms are provided at a predetermined angle relative to the vertical axis of the doll, e.g., an angle of 45 degrees. The vertically extensible pin enables a series of dolls to be stacked vertically. The angularly disposed arms enable the dolls to be linked angularly of the vertical axis.

Various means are provided for projecting and retracting the vertically extensible pin. In the simplest form of the invention the pin may be manually moved into either extended or retracted position. One method of accomplishing this result is to insert a pin of another toy into the base of the subject toy and thereby push the pin of the subject toy into upwardly projecting position. Returning the upwardly projected pin into retracted position involves the simple expedient of pushing the pin downwardly with ones finger.

This invention also provides helical cam and cam follower means for moving the pin in either direction. The helical cam means may be formed on the pin itself and the cam follower may be provided in the body of the doll. Conversely the cam means may be formed in the body of the doll and the cam follower on the pin.

Actuating means may be provided in the form of a rotatable head on the doll or a rotatable base supporting the doll. In either case the pin is keyed to the rotatable element and either the cam is caused to rotate relative to the cam follower or the cam follower is caused to rotate relative to the cam.

It will be understood that the toy is intended for the amusement and training of young children. It teaches the principles of projecting and retracting parts, pin-and-socket constructions, joints or connections, and building and balancing techniques. It is a relatively low cost toy with relatively few moving parts and a relatively simple modus operandi. Although these principles are quite elementary, they may be applied to many forms of stackable toys in addition to the stackable dolls which exemplify the invention. For example, the dolls may be stacked on vehicles equipped with projecting pins. Also, instead of stacking one doll upon another it is possible to stack various articles of clothing and accessories upon a doll, each such article of clothing or accessory being provided with a socket adapted to receive one of the pin formations on the doll. All kinds of stackable doll and toy combinations may be provided within the principles and claims of the present invention provided that in each case stacking results from engaging a pin with a socket. It is also apparant that the provision of a retractable pin renders it possible for the child to play with the toy as an individual unit separate and apart from like toys with which it may be joined and assembled.

DESCRIPTION OF DRAWING

FIG. 1 is a perspective view showing a plurality of stackable toys made in accordance with the present invention, some of said toys being shown in stacked relationship, other such toys being shown in position for stacking.

FIG. 2 is an enlarged, perspective view, partly broken away and in section, showing the internal mechanism of a toy made in accordance with one form of the invention.

FIG. 6 is a cross-sectional view taken on the line 6—6 of FIG. 4.

FIG. 7 is a cross-sectional view taken on the line 7—7 of FIG. 4.

DESCRIPTION OF PREFERRED EMBODIMENTS OF THE INVENTION

Figure 3:
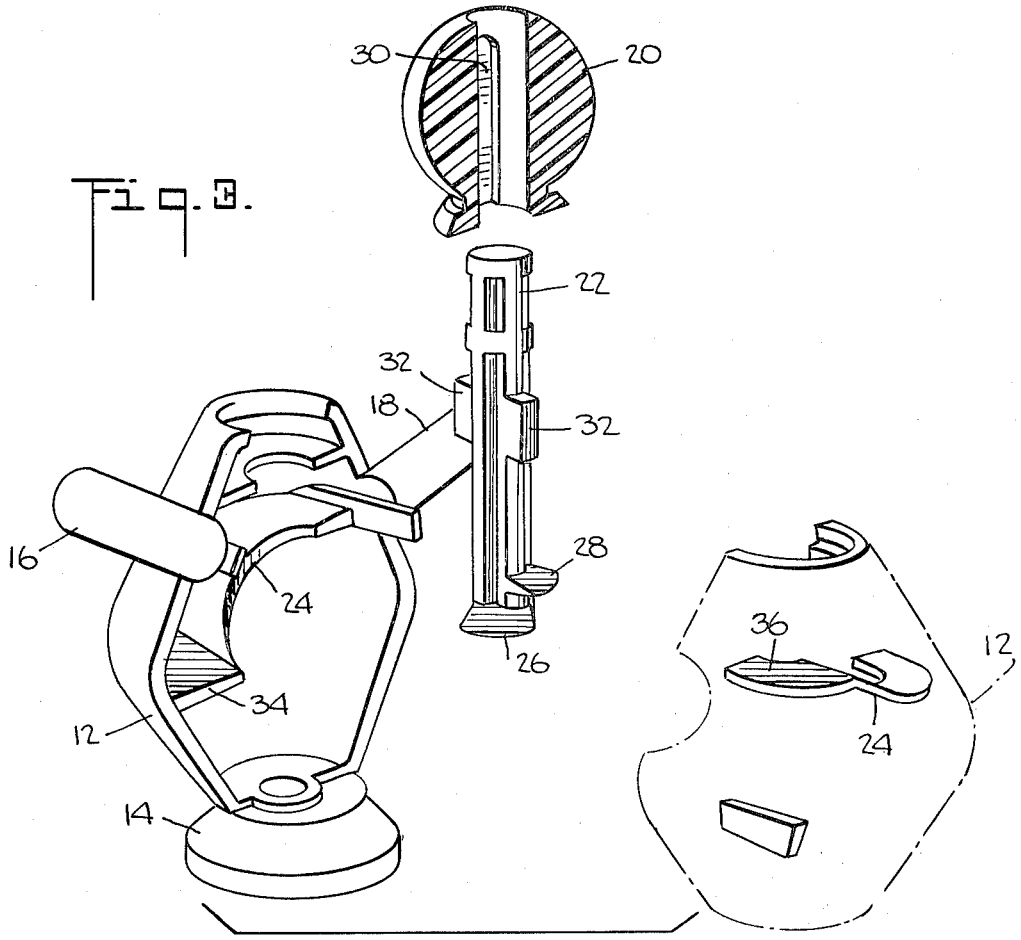
FIG. 3 is an enlarged, perspective, exploded view showing the several parts of said toy.
Figure 4:
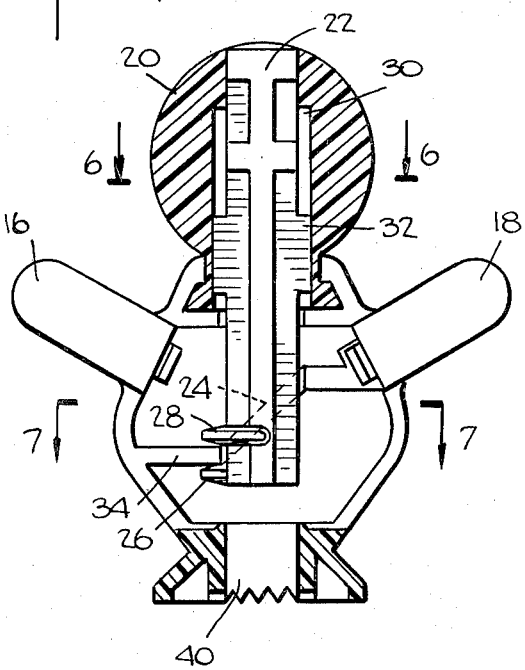
FIG. 4 is a view of the same toy, partly broken away and in vertical section, the movable pin of said toy being shown in retracted or recessed position.

Referring now to the first form of the invention as depicted in the drawing, specifically FIGS. 2–7, it will be observed that toy 10 comprises a hollow body 12, a base 14 supporting said body, arms 16 and 18 extending from said body, a head 20 rotatably supported by said body, and extensible pin 22 mounted within said body and said head and supported therein for both axial and rotational movement relative to the body, and helical projecting and retracting means for projecting the pin partly out of the head and retracting it back into recessed position therein. The helical projecting and retracting means comprises a helical cam 24 formed within the body of the toy and fixed relative thereto, and a pair of cam followers 26, 28 formed on the pin and engaging opposite surfaces of the helical cam. Head 20 is provided with a pair of oppositely disposed, vertically extending slots 30 and pin 22 is provided with a pair of key elements 32 which engage said slots. Consequently, when the body of the toy is manually immobilized while the head is manually rotated the pin will rotate with the head and the cam followers will ride up upon the helical cam, thereby causing the pin to project from its retracted position shown in FIG. 4 to its projected position shown in FIG. 5. When the body is immobilized and the head is rotated in the opposite direction, again the pin will rotate and the cam followers will ride down the helical cam causing the pin to move back to its retracted position shown in FIG. 4.

It will be noted that the helical cam 24 is provided at its lower end with a flat, horizontal section 34 and it is provided at its upper end with a similar flat horizontal section 36, these two flat sections being continuous with the helical cam. It will be understood that the cam followers are engageable with these two flat sections in order to stablilize the pin in its retracted and projected positions. By way of illustration, the helix extends around an angle of approximately 270 degrees. The upper flat section 36 extends through an angular distance of 90 degrees, the total angular sweep of both the helix and the upper flat section extending through a full 360 degrees. The lower flat section 34 may also cover an angular distance of 90 degrees so that the total angular sweep of the helix and the lower flange section 34 will also come to 360 degrees. This is purely illustrative.

In the operation of the toy illustrated in FIGS. 2–7, the head is rotated approximately 90 degrees in order to cause the cam follower to traverse the lower flat section 34 and to reach the helical cam 24. The head is then rotated an additional 270 degrees in order to raise the pin to its projected position, this being accomplished by the cam followers traversing the helical cam and reaching the upper flat section 36. Further rotation of the head an additional 90 degrees relative to the body will cause the cam followers to traverse the upper flat section 36 and this will provide secure support for the pin in its upwardly projecting position. The entire process is repeated by rotating the head in the opposite direction relative to the body in order to lower the pin back to its retracted position and enable the cam followers, by their engagement with the lower flat section 34, to retain the pin in its retracted position.

Figure 5:
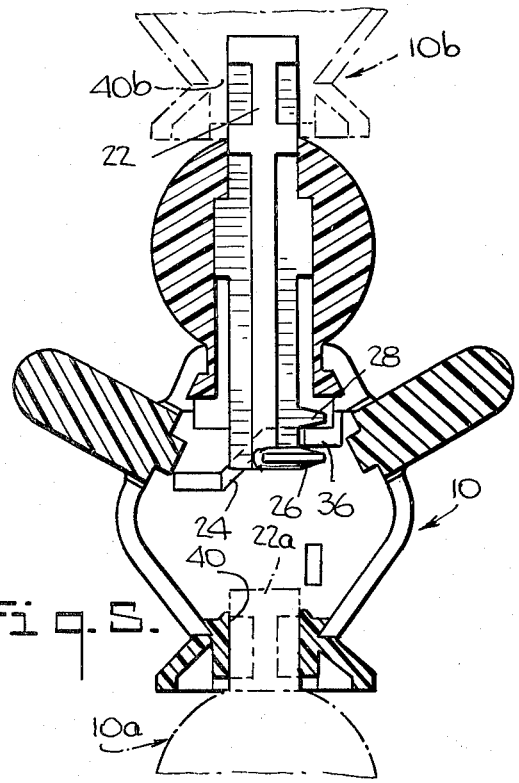
FIG. 5 is a view similar to that of FIG. 4 but showing the pin in projected position as a result of rotating the head of the toy relative to the toy body.

It will be observed that a socket 40 is provided in the base of the toy in vertical registration with the extensible pin. Socket 40 is adapted to receive the extensible pin of a second toy made in accordance with the subject embodiment of the invention. This is illustrated in FIG. 5 where pin 22*a* projecting from toy 10*a* is seated within socket 40 of toy 10. At the same time pin 22 of said toy 10 may be seated within socket 40*b* formed in a third toy 10*b*. We thus have three toys stacked one relative to the other and this process may be continued with additional toys stacked both above and below the three stacked toys illustrated in FIG. 5.

The present invention provides other stacking means than those last above discussed, namely, the stacking facilities of arms 16 and 18. These arms are fixed relative to the body of the toy and they project therefrom at any desired angle, preferably 45 degrees relative to the vertical axis of the toy, including its extensible pin. These arms have a cross-sectional diameter approximating the cross-sectional diameter of the extensible pin. It follows, therefore, that arms 16 and 18 are engageable with socket 40 of other toys made in accordance with the subject embodiment. This is illustrated in FIG. 1 wherein arm 18 of toy 10 is seated within the base socket of like toy 10*a*.

Socket 40 is also adapted to receive other pins which may be provided in a toy assembly such as is depicted in FIG. 1. It will be observed that FIG. 1 shows a toy helicopter 50 including a cabin or fuselage 52, a tail section 54 and propeller blades or wings 56. Projecting forwardly from the cabin or fuselage is a forwardly extending pin 58 which is engageable with socket 40 of toy 10*c* made in accordance with the subject embodiment of the invention. The tail section 54 is provided with laterally extending pins 60 which are engageable with socket 40 of still another toy 10*d* made in accordance with the subject embodiment of the invention. Cabin or fuselage 52 may be provided with an upwardly extending pin 62 which is engageable with socket 40 of another toy 10*e* made in accordance with the subject embodiment of the invention. The extensible pin of toy 10*e* may project upwardly to provide means for rotatably supporting propeller blades or wings 56 and for engaging socket 40 of toy 10. Additionally the extensible pin 22 of toy 10 is engageable with a socket similar to socket 40, formed in cap 64. In short, FIG. 1 illustrates various arrangements of toys and accessories wherein stacking or assembly results from pin-and-socket connections. Other toys and other arrangements involving the same pin-and-socket principle are clearly encompassed within the scope of the invention and of the appended claims.

Figures 8, 9, 10, 11, 12:
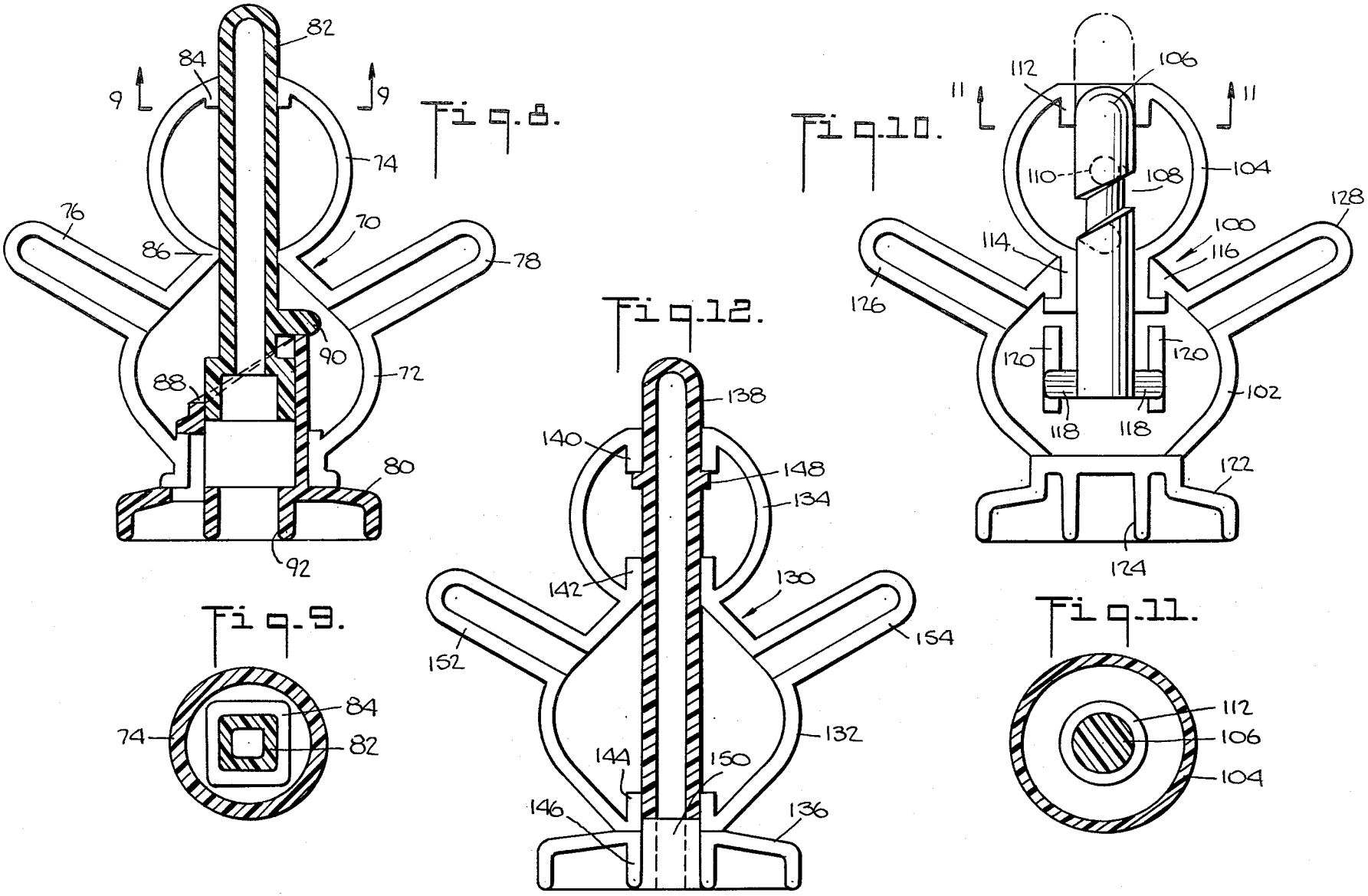
FIG. 8 is a view similar to that of FIG. 5 but showing a toy made in accordance with a second form of the invention.
FIG. 9 is a section on the line 9—9 of FIG. 8.
FIG. 10 is a view similar to that of FIG. 4 but showing a toy made in accordance with a third form of the invention.
FIG. 11 is a section on the line 11—11 of FIG. 10.
FIG. 12 is a view similar to that of FIG. 5 showing a toy made in accordance with a fourth form of the invention.

Turning now to the modification depicted in FIG. 8 it will be observed that doll 70 comprises a hollow body 72 having a head 74 and arms 76, 78 integral therewith, a base 80 rotatably connected to the lower end of hollow body 72, and an extensible pin 82 extending through the body and adapted to project through an opening in the head. Pin 82 is non-rotatable relative to the head and body of toy 70. This non-rotatable condition may be provided by key means (as illustrated in connection with the first embodiment of the invention) or by forming pin 82 in non-cylindrical shape, e.g., in square cross section. The bearing sections 84 and 86 of the head and body may also define square openings complementing the square cross-sectional shape of the pin. See FIG. 9.

It will now be noted that base 80 is provided with a helical cam surface 88 which substantially encircles the lower end of pin 82. Cam follower 90 extends laterally from pin 82 and rides on helical cam 88 of the base. If desired, at each end of helical cam surface 88 there is a horizontal flat section which is continuous with the helical cam surface. When hollow body 72 of the toy is held in one hand and base 80 is rotated in one direction with the other hand the result will be to cause cam follower 90 to ride up on the cam surface and to project the upper end of pin 82 outwardly from the head of the toy. It will be understood that when cam follower 90 is in engagement with the upper flat section adjoining the cam surface pin 82 will be securely supported in its upper, outwardly projected position. When the base is rotated in the oposite direction cam follower 90 will ride down the helical cam surface until it reaches the lower flat section, at which point the pin 82 will be securely supported in its lower, retracted position. For illustrative purposes helical cam 88 extends angularly around pin 82 a distance of approximately 270 degrees and each of its flat sections extends an angular distance of approximately 90 degrees.

As is the case with the first embodiment of the invention, the second embodiment which is shown in FIGS. 8 and 9 is provided with a socket 92 in its base structure and this socket is adapted to receive the outwardly projecting pin of a second toy made in accordance with the same embodiment of the invention. Actually, toy 70 is also stackable relative to the first embodiment of the invention, that is, the upwardly projecting end of pin 82 is the mechanical or structural equivalent of the upwardly projecting end of pin 22 and socket 92 corresponds to socket 40 of the first form of the invention.

Referring now to the third embodiment of the invention as illustrated in FIGS. 10 and 11 it will be seen that toy 100 has a hollow body 102, a head 104 rotatably mounted on said body and a pin 106 extending axially of said head and body. A helical groove 108 is formed in pin 106 and a cam follower 110 is provided on the inner wall of head 104 for engagement with said helical groove. The helical groove may extend an angular distance of approximately 270 degrees around the pin and the helical groove may flatten out at both ends to form upper and lower flat sections corresponding to the flat sections of the previously described embodiments of the invention.

It is clear from FIGS. 10 and 11 that pin 106 has a circular cross section and that it is supported by annular bearing elements 112 and 114 respectively. By the same token, bearing element 114 is itself rotatably supported by cylindrical bearing 116 formed in the body section of the toy. The lower end of pin 106 is provided with a pair of radially extending guide elements 118 which ride against linear bearing elements 120, these linear bearing elements being provided on the inner wall of the hollow body of the toy. Base 122 is fastened to or joined with the lower end of the hollow body and there is no relative movement between the two. A socket 124 is formed in base 122 in registration with pin 106 and this socket 124 performs the same function as sockets 92 and 40 above mentioned. When the body is held in one hand and the head is rotated in one direction by the other hand cam follower 110 will ride up in helical groove 108, starting at a flat section at the lower end of said helical groove and ending at a flat section at the upper end of said helical groove. When cam follower 110 is positioned on either of said flat sections it provides a firm support for the pin. Again, and purely as an illustration, the helical groove 108 may extend around the pin for an angular distance of approximately 270 degrees and each of the flats may extend a further angular distance of 90 degrees. Toy 100, like the other toys made in accordance with the principles of this invention, is provided with a pair of pin-shaped arms 126, 128 and these arms are adapted to engage socket 124 of toys of like construction.

Referring now to the fourth embodiment of the invention as illustrated in FIG. 12 it will be seen that toy 130 is provided with a hollow body 132, a head 134 joining said hollow body and a base 136 secured to and supporting said hollow body. Extending through the hollow body and head which is joined therewith is an extensible pin 138. There are three bearings which slidably support said pin, namely bearing 140 at the upper end of the head, bearing 142 at the lower end of the head and bearing 144 at the lower end of the hollow body. Base 136 is provided with a collar 146 which registers with bearings 144, 142 and 140. Collar 146 also performs the function of a bearing with respect to pin 138. The cross-sectional shape of the pin and its respective bearings, including collar 146, is a matter of design. For example, if the pin defines a cylinder so do the bearings. In this embodiment of the invention it is immaterial whether the pin is rotatable relative to the head and body of the toy or whether it is fixed against rotational movement. It suffices that the pin is longitudinally movable relative to the head and body of the toy. It will now be noted that a radial shoulder 148 is formed on pin 138 between bearings 140 and 142. It is this shoulder which limits the vertical movement of the pin relative to the head and body of the toy by engagement with said bearings 140 and 142. The range of vertical movement is determined by the spacing of said bearings and the vertical dimension of said shoulder.

As in the case of the other embodiments of the invention hereinabove discussed, toy 130 is provided with a socket 150 formed in its base. Actually, socket 150 is defined by bearing 146. Socket 150 will receive the upwardly projecting end of pin 138 of a second toy 130, and socket 150 of a third toy 130 will receive the upwardly projecting end of the pin 138 of the first mentioned toy 130. In such manner a plurality of toys 130 may be stacked one upon the other. It will further be noted that toy 130 is provided with pin-shaped arms 152, 154 and once again it will be understood that these arms are engageable with socket 150 in the base of all toys corresponding to toy 130. By the same token the pin and socket of toy 130 may be deemed interchangeable with the pin and socket of each of the other embodiments of the invention above described.

Toy 130 is not provided with a helical cam means for projecting or retracting its extensible pin. Pin 138 may be moved to its projected position (shown in FIG. 12) by simply inserting another pin (e.g., arm 152 or arm 154 of a second toy 130) into socket 150, thereby engaging and pushing pin 138 to its upward position. Pin 138 may be returned to its retracted position by withdrawing the actuating pin from socket 150 and gravity or a slight digital push will return pin 138 to its retracted position.

The foregoing is illustrative of preferred forms of the invention and as will be understood these forms are intended to illustrate the invention and not to limit its scope except to the extent of the scope and limitations of the appended claims.

We claim:

1. A stackable toy, comprising:

(a) a doll, (b) a pin mounted in said doll for longitudinal movement relative to the doll, (c) said pin being movable in one direction to outwardly projecting positiion and in the opposite direction to inwardly retracted position, (d) a socket formed in said doll in registration with said pin, (e) said socket being engageable with the pin of a second such doll when said pin is in outwardly projecting position, (f) the pin of the first doll, when in outwardly projecting position, being engageable with the socket of a third such doll, (g) whereby the first doll is stackable with the second and third such dolls, (h) said doll comprising a body, a head and a base, (i) said body and head having a continuous passage formed therein along the longitudinal axis of the doll and said passage being open at the top of said head, (j) said pin being mounted within said passage and being longitudinally movable therein between retracted and outwardly projecting positions relative to the doll, (k) means for moving the pin into retracted and projecting positions, (l) said projecting and retracting means comprising a helical cam and cam follower means between the doll and the pin.

2. A stackable toy in accordance with claim 1, wherein:

(a) the doll head is rotatable relative to the doll body about the longitudinal axis of the doll, (b) the pin being keyed to the head for rotational movement therewith while being free to move longitudinally through the passage, (c) the helical cam being formed on the doll body, (d) the cam follower means being formed on the pin and being engageable with the helical cam on the doll body, (e) whereby rotating the head relative to the body in one direction causes the pin to project outwardly from said passage, and (f) rotating the head in the opposite direction causes the pin to retract in said passage.

3. A stackable toy in acordance with claim 2, wherein:

(a) non-helical extensions are provided on opposite ends of the helical cam, (b) said cam follower means being engageable with the non-helical extensions to support the pin in its projected and retracted positions.

4. A stackable toy in accordance with claim 1, wherein:

(a) the doll head is rotable relative to the doll body about the longitudinal axis of the doll, (b) the pin being keyed to the doll body to prevent rotational movement of the pin relative to the body while permitting longitudinal movement of said pin through the passage, (c) the helical cam being formed on the pin, (d) the cam follower means being formed on the doll head and being engageable with the helical cam on the pin, (e) whereby rotating the head relative to the body in one direction causes the pin to project outwardly from said passage, and (f) rotating the head in the opposite direction causes the pin to retract in said passage.

5. A stackable toy in accordance with claim 4, wherein:

(a) non-helical extensions are provided on opposite ends of the helical cam, (b) said cam follower means being engageable with the non-helical extensions to support the pin in its projected and retracted positions.

6. A stackable toy in accordance with claim 1, wherein:

(a) the doll base is rotatable relative to the doll body and head about the longitudinal axis of the doll, (b) the pin being keyed to the doll body or head to prevent rotational movement of the pin relative to the doll body and head while permitting longitudinal movement of said pin through the passage, (c) the helical cam being formed on the doll body, (d) the cam follower means being formed on the pin and being engageable with the helical cam on the doll body, (e) whereby rotating the base relative to the doll body and head in one direction causes the pin to project outwardly from said passage, and (f) rotating the base in the opposite direction causes the pin to retract in said passage.

7. A stackable toy in accordnce with claim 6, wherein:

(a) non-helical extensions are provided on opposite ends of the helical cam, (b) said cam follower means being engageable with the non-helical extensions to support the pin in its projected and retracted positions.

* * * * *